US005604472A

United States Patent [19]

Uppaluri et al.

[11] Patent Number: 5,604,472

[45] Date of Patent: Feb. 18, 1997

[54] RESONATOR MOUNTING MECHANISM

[75] Inventors: Moorthy K. Uppaluri, Mount Prospect; Ronald Lepinski, Chicago, both of Ill.

[73] Assignee: Illinois Superconductor Corporation, Mount Prospect, Ill.

[21] Appl. No.: 566,013

[22] Filed: Dec. 1, 1995

[51] Int. Cl.[6] ..... H01P 7/00

[52] U.S. Cl. ..... 333/219; 248/251; 248/316.6

[58] Field of Search ..... 333/219, 219.1; 248/230.5, 251, 316.6, 74.1

[56] References Cited

U.S. PATENT DOCUMENTS

| | | | |
|---|---|---|---|
| 3,775,701 | 11/1973 | Dickens | 331/96 |
| 3,783,418 | 1/1974 | Redwine | 333/188 |
| 4,053,856 | 11/1977 | Fisher et al. | 333/219 |
| 4,384,495 | 5/1983 | Paros | 73/862.59 |
| 4,423,397 | 12/1983 | Nishikawa et al. | 333/219 |
| 4,504,788 | 3/1985 | Froncisz et al. | 324/316 |
| 4,560,965 | 12/1985 | Gosling et al. | 333/219 |
| 4,563,662 | 1/1986 | Thorpe | 333/219 |
| 4,675,691 | 6/1987 | Moore | 343/908 |
| 4,682,131 | 7/1987 | May | 333/202 |
| 4,795,992 | 1/1989 | Saito et al. | 333/206 |
| 4,829,537 | 5/1989 | Baer | 372/66 |
| 4,853,660 | 8/1989 | Schloemann | 333/204 |
| 4,892,276 | 1/1990 | Alessio | 248/230.5 |
| 5,030,876 | 7/1991 | EerNisse | 310/353 |
| 5,099,756 | 3/1992 | Franconi et al. | 600/10 |
| 5,323,129 | 6/1994 | Harris | 333/219 |
| 5,435,506 | 7/1995 | Wiley et al. | 248/74.1 |

OTHER PUBLICATIONS

J. R. Delayen et al., "Test of a $\beta \simeq 0.1$ Superconducting Split Ring Resonator"; *IEEE Transactions on Magnetics,* vol. Mag–17, No. 1, Jan. 1981, pp. 939–942.

G. J. Dick et al., "The Split–Loop Resonator as a Superconducting Heavy Ion Accelerating Element"; *IEEE Transactions on Magnetics,* vol. Mag–13, No. 1, Jan. 1977, pp. 512–515.

*Primary Examiner*—Benny Lee
*Assistant Examiner*—Barbara Summons
*Attorney, Agent, or Firm*—Marshall, O'Toole, Gerstein, Murray & Borun

[57] ABSTRACT

A resonator mounting mechanism has a stand which can be attached to a wall. The stand has two wings and a groove in between the wings. A cap also has wings and a groove in between the wings where the cap is placed over the stand so that the grooves form an opening for receiving a resonator. The wings on the stand are secured to the wings on the cap by rings. The grooves in the stand and cap may have a uniform circular cross-section or may be curved to accommodate various curved resonator shapes.

19 Claims, 6 Drawing Sheets

FIG. 8
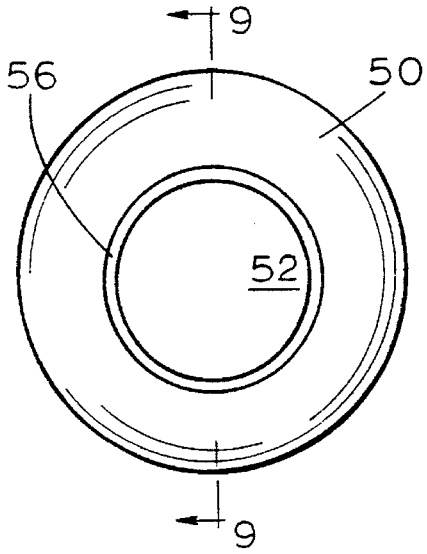
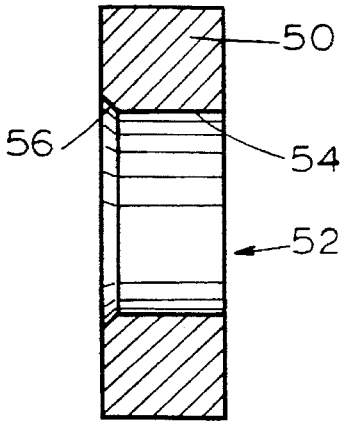
FIG. 9
FIG. 10
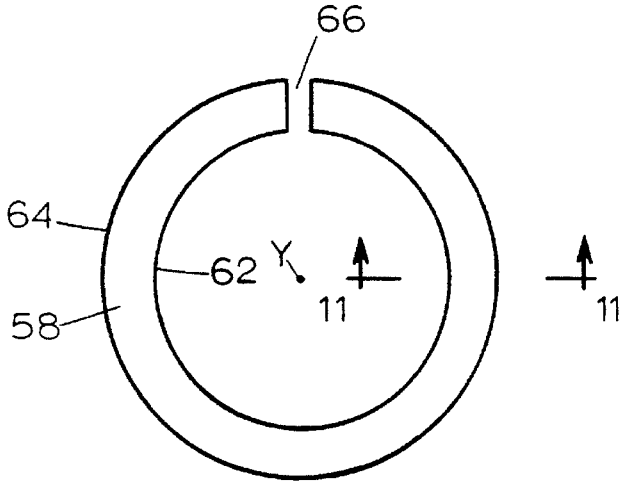
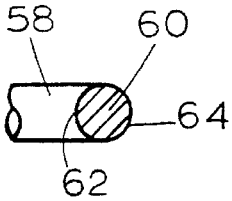
FIG. 11

FIG. 12
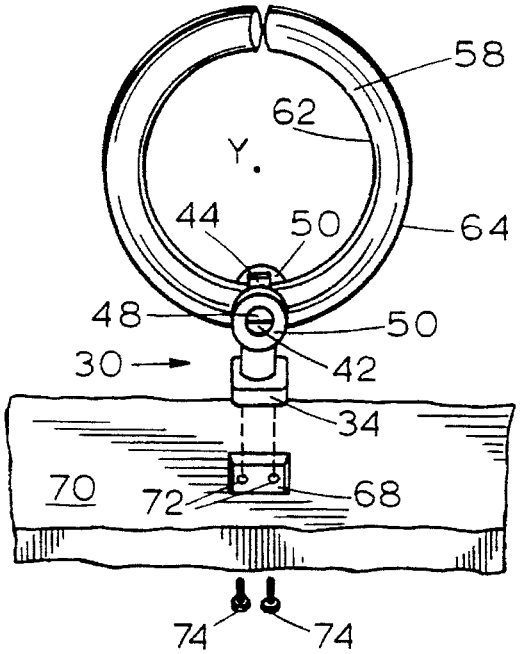
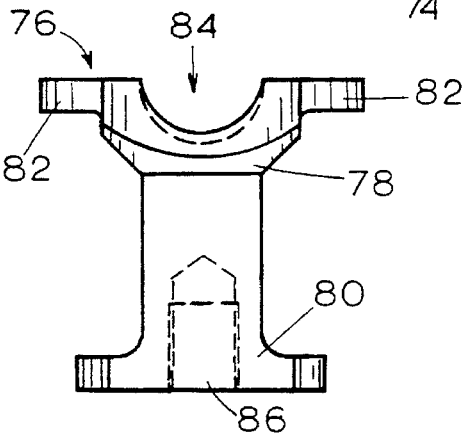
FIG. 13
FIG. 14
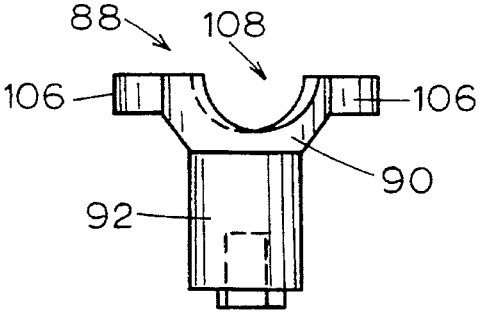
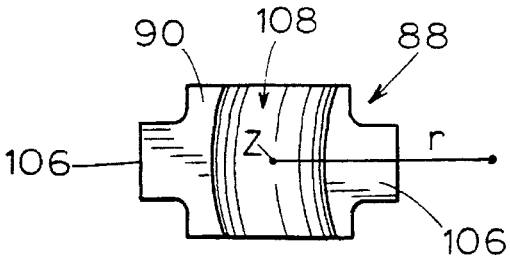
FIG. 15

FIG. 17
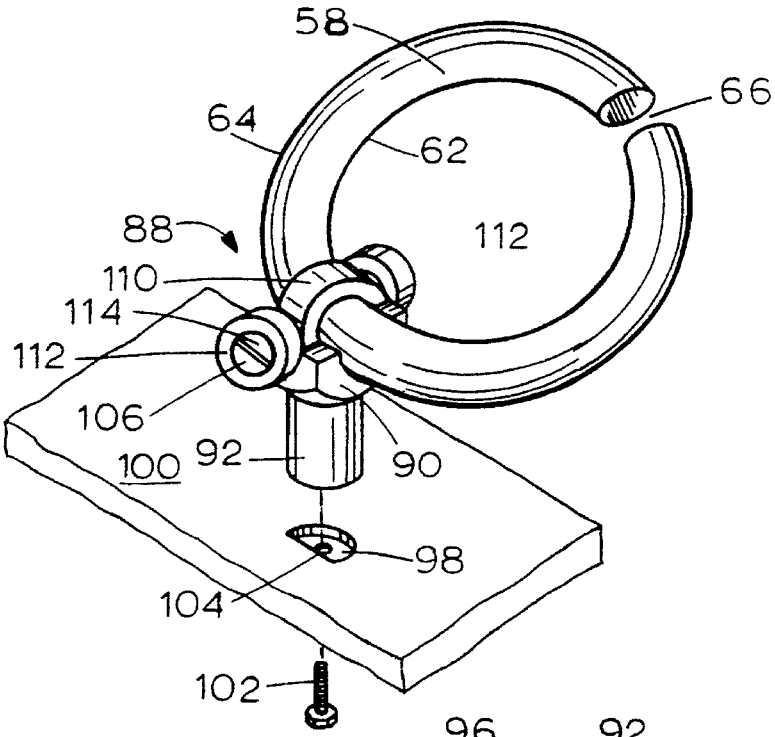
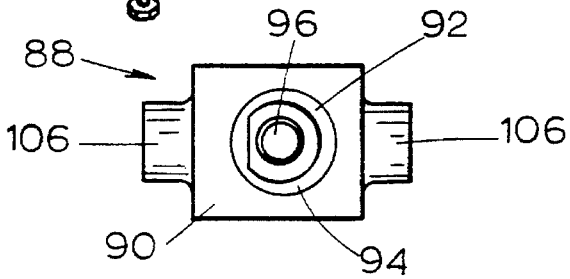
FIG. 16
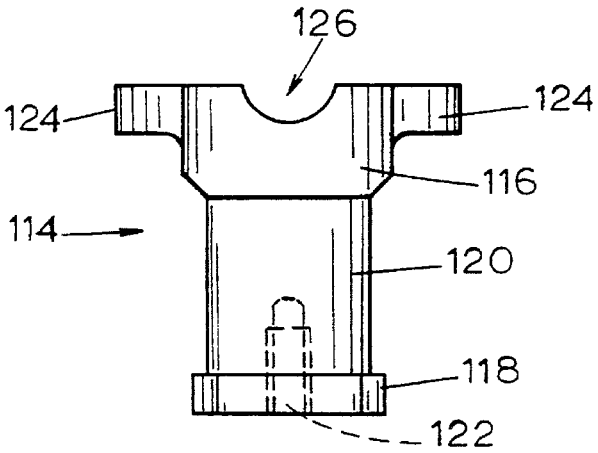
FIG. 18

RESONATOR MOUNTING MECHANISM

The present invention relates generally to devices for holding a structure in place, and more particularly to devices for holding a resonant structure to the wall of a resonant cavity.

BACKGROUND ART

Numerous types of resonant structures, often used as electromagnetic filters, are known in the art. For most applications, a conductor and/or dielectric material must be held in a fixed position with respect to a wall such as a resonant cavity wall of a filter housing. In some applications, conductors are held between slabs of dielectric which are forced together using screws, springs or sometimes adhesive. In many applications, however, it is desirable that a resonator have little physical contact with other objects. Small screws or bolts may be placed through an opening in a resonator such as a dielectric puck, in order to attach the resonator to another structure with minimal physical contact. Although some degradation in performance of the resonator can undoubtedly be attributed to such mounting schemes, that degradation was generally small in comparison to other losses which affected the overall quality of the resonator.

The introduction of superconducting materials into resonant structures has significantly decreased the surface resistance of those structures, thereby raising the quality factor "Q" of the filtering devices made of the resonant structures. Losses due to mounting which were previously insignificant, have now become an important limiting factor in the quality of a filter. Prior methods, such as providing a threaded opening or the like in a resonator, are no longer desirable, since they interfere with the electromagnetic fields at the surface of the resonator. In general, the greater the size of a mounting mechanism or the more contact it has with the resonator, the more likely it is to interfere with the electromagnetic properties of the resonator or resonant cavity in which it is used. The desire for reduced size in mounting mechanisms is at odds with the need to hold the resonator at a precise location with minimal chance for mounting failure. In the case of filters using superconductors, the structural demands on the mounting mechanism are increased, since that mechanism will be subjected to temperatures ranging from room temperature to hundreds of degrees below 0° C.

SUMMARY OF THE INVENTION

A resonator mounting mechanism for attaching a resonator to a wall or other structure has a stand which can be secured to the wall at a first end of the stand. A head at the second end of the stand has a groove and at least one wing. A cap has at least one wing where the wing on the cap can be held in a fixed position with respect to the wing on the head. The cap covers at least a portion of the groove in order to hold the resonator in the groove.

The stand may be secured to the wall so that the stand is restricted from moving away from the wall and restricted from rotating with respect to the wall. The mounting mechanism may be restricted from movement away from the wall by use of a threaded opening in the mechanism and a screw.

The stand may have a central axis and the groove may be generally perpendicular to the central axis. The cap may have a groove and the groove may be located over the groove of the head when the cap is secured to the head. The grooves from an opening in the mechanism for holding the resonator. The opening may have a generally circular cross-section.

The groove in the head may be curved. The curve of the groove has a radius of curvature and the radius of curvature may lie in a plane which is generally perpendicular to the axis of the stand. The radius of curvature may also lie in a plane which is generally parallel to the central axis.

The resonator mounting mechanism may have first and second wings on the stand disposed on opposite sides of the groove of the head. Third and fourth wings may be disposed on opposite sides of the cap. The first wing is secured to the third wing and the second wing is secured to the fourth wing to hold the cap to the stand. The wing on the cap may be held in a fixed position with respect to a wing on the stand by a ring having an aperture. The wing on the head and the wing on the cap are inserted into the aperture to secure the cap to the stand. The aperture in the ring may be circular and each wing may be semi-circular. The aperture in the ring may be bounded by at least one wall and the wall may be tapered. The wings on the stand and the wings on the cap may also be tapered.

The groove in the cap and the groove in the head of the stand may form an opening for holding a resonator. The resonator may have a cross-section and the opening may have a generally complimentary cross-section to the cross-section of the resonator. The resonator mounting mechanism may be used in combination with a resonant structure held by the mounting mechanism. The mounting mechanism may be attached to a wall where the resonator mounting mechanism holds the resonant structure in a fixed position with respect to the wall.

Other features and advantages are inherent in the mounting mechanism of the present invention or will become apparent to those skilled in the art from the following detailed description in conjunction with the accompanying drawing.

BRIEF DESCRIPTION OF THE DRAWINGS

FIG. 8 is a top-plan view of a securing ring for a mounting mechanism of the present invention;

FIG. 9 is a sectional view taken along the line 9—9 of FIG. 8;

FIG. 10 is a top-plan view of a toroid resonator;

FIG. 11 is a cross-sectional view taken along the line 11—11 of FIG. 10;

FIG. 12 is an exploded-perspective view of a resonator, resonator mounting mechanism and wall;

FIG. 13 is a side-elevational view of a second embodiment of a stand for a resonator mounting mechanism of the present invention;

FIG. 14 is a side-elevational view of a third embodiment of a stand for a resonator mounting mechanism of the present invention;

FIG. 15 is a top-plan view of the stand of FIG. 14;

FIG. 16 is a bottom-plan view of the stand of FIG. 14;

FIG. 17 is an exploded-perspective view of a resonator, resonator mounting mechanism and wall;

FIG. 18 is a side-elevational view of a fourth embodiment of a stand for a resonator mounting mechanism of the present invention:

DETAILED DESCRIPTION OF THE PREFERRED EMBODIMENT

Figure 1:
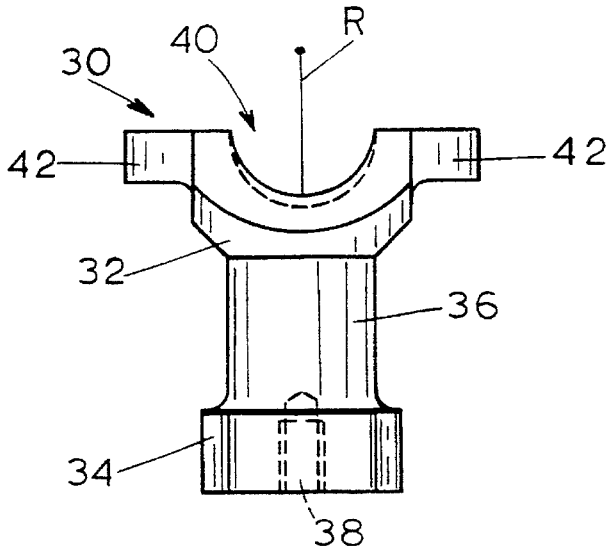
FIG. 1 is a side-elevational view, partially in phantom, of a stand for a mounting mechanism of the present invention.
Figure 2:
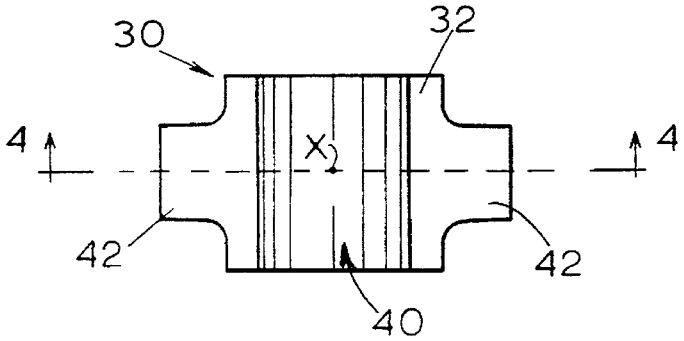
FIG. 2 is a top view of the stand of FIG. 1.
Figure 3:
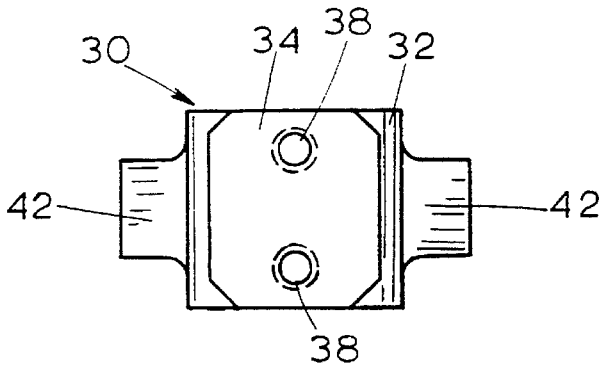
FIG. 3 is a bottom view of the stand of FIG. 1.
Figure 4:
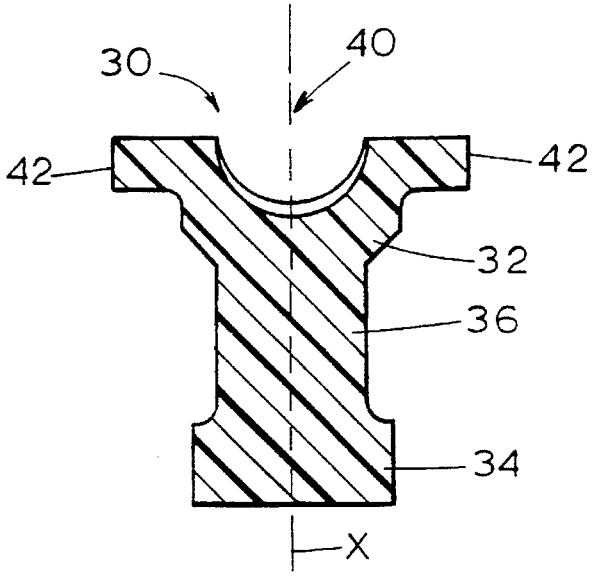
FIG. 4 is a cross-sectional view taken along the line 4—4 of FIG. 2.

Referring initially to FIGS. 1–4, a mounting mechanism for a resonator has a stand indicated generally at 30 including a head 32 and a base 34 connected by a post 36. The base 34 has a generally rectangular shape where the comers of the rectangle are chamfered (FIG. 3). The base 34 has two threaded openings 38 which are used to attach the stand 30 to a wall or other structure. In the head 32 of the stand 30 is a groove 40 which is generally perpendicular to a central axis X passing through the stand 30 (FIGS. 2 and 4). On each side of the groove 40 is a wing 42. As can best be seen in FIG. 4, the groove 40 does not have a uniform cross-section along its length, but instead is deepest in the middle of the groove 40 (the plane of FIG. 4 between the wings 42). The groove 40 has a generally semi-circular cross-section to accommodate a resonator with a generally circular cross-section. The groove 40 is deeper at the center in order to accommodate resonators, such as toroids, which are curved. Although it may be machined with a variety of curves, the groove 40 has a circular curvature about a radius of curvature R (FIG. 1). The radii of the curve lie in a plane which is parallel to (or includes) the central axis X of the stand 30.

Figure 5:
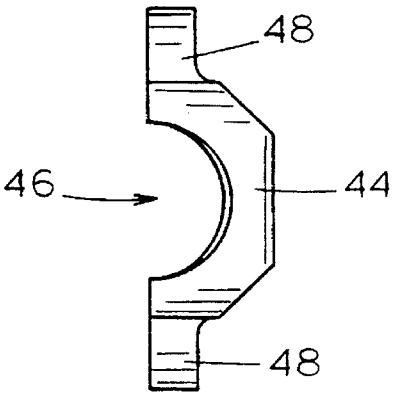
FIG. 5 is a side view of a cap of a mounting mechanism of the present invention.
Figure 6:
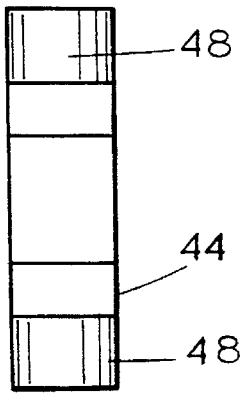
FIG. 6 is a top view of the cap of FIG. 5.
Figure 7:
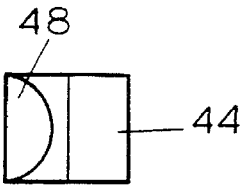
FIG. 7 is an end view of the cap of FIG. 5.

Referring now to FIGS. 5–7, a cap 44 has a groove 46. On each side of the groove 46 is a wing 48. As best seen in FIG. 7, the wings 48 have a semi-circular cross-section designed to mate with the wings 42 of the stand 30 in order to form a generally circular peg. The groove 46 has a generally circular cross-section, however, the cross-section is not uniform across the length of the groove, but is more shallow at its center than at its ends (FIG. 5). The groove 46 is thus similar to the groove 40, except that the deepest portion of the groove 40 is its middle while the deepest portion of the groove 46 is at its ends.

FIGS. 8 and 9 disclose a ring 50 for holding the cap 44 to the stand 30. The ring 50 has a circular cross-sectioned opening 52 which is bounded primarily by a wall 54. A tapered wall 56 also bounds a portion of the opening 52. The ring 50 fits over a wing 42 and a wing 48 in order to hold the cap 44 to the stand 30. The tapered wall 56 is the first section of the ring 50 which is placed over the wings 42 and 48 and helps to force the wings 42 and 48 together to provide a stronger structure. The wings 42 and 48 may also be slightly tapered so that the ends of the wings (away from their respective grooves) are narrower than the rest of the wing.

Referring to FIGS. 10 and 11, a resonator 58 has a circular cross-section 60. The resonator 58 is curved about a central axis Y so as to have an inner circular edge 62 and an outer circular edge 64. The radius of curvature of the outer edge 64 is approximately equal to the radius of curvature R of the groove 40 of the stand 30 (FIG. 1). The resonator 58 has a generally toroidal shape except for a gap 66.

FIG. 12 shows the stand 30, the cap 44 and the rings 50 holding the resonator 58. The rings 50 are placed over the wings 42 and 48 which together have the shape of a round peg. Many different wing shapes can be used instead of semicircles. In such cases it will be desirable to change the shape of the opening 52 (FIG. 8) through the ring 50 to maximize the contact between the ring 50 and the wings 42, 48. A circular opening 52 is most desirable because there are no comers which might provide a weak area that could crack, particularly at cryogenic temperatures. It is also possible to use other types of clamps, including bolts or screws, through the wings or even a hinge on one set of wings and a clamping means of some type on the other set of wings.

The resonator 58 is oriented so that its central axis Y is generally perpendicular to the central axis of the stand 30. The outer edge 64 of the resonator 58, having a radius of curvature similar to that of the groove 40 (FIG. 4), engages the groove 40 and is inhibited from rotating. Similarly, the curve of the groove 46 of the cap 44 (FIG. 5) matches the curvature of the inner edge 62 of the resonator 58.

The base 34 of the stand 30 fits into a recess 68 of a wall 70. The recess 68 is shaped to match the base 34 so that the base 34 does not rotate with respect to the wall 70 when it is inserted into the recess 68. Numerous other base and recess shapes could be used to prohibit rotation. Passing through the wall 70 in the recess 68 are two passageways 72 which receive bolts 74. The bolts 74 pass through the wall 70 and into the threaded openings 38 in the base 34 (FIGS. 1 and 3) which prevent the stand 30 from being displaced from the wall 70 and the recess 68.

A second embodiment of a resonator mounting mechanism, shown in FIG. 13, has a stand indicated generally at 76 with a head 78 and a base 80. The head 78 has wings 82 and a groove 84. The groove 84 is curved in a fashion similar to the groove 40 of the stand 30 (FIG. 1) and is also used for mounting a resonator with a radius of curvature parallel to the central axis of the stand. The base 80 has a single threaded opening 86 for insertion of a screw or bolt for attaching the stand 76 to a wall or other structure.

Referring now to FIG. 14–17, a resonator mounting mechanism is disclosed for mounting a curved resonator where the radius of curvature of the resonator is held perpendicular to the central axis of the mounting mechanism. The mechanism consists of a stand 88 having a head 90 attached to a post 92. At the bottom of the post 92 is a generally D-shaped rim 94 surrounding a threaded opening 96 (FIG. 16). The D-shaped rim 94 fits into a D-shaped recess 98 in a wall 100 (FIG. 17). A bolt 102 passes through a passageway 104 in the wall 100 and into the threaded opening 96 in the stand 88. The bolt 102 prevents the stand 88 from being displaced from the wall 100, and the cooperation of the D-shaped rim 94 with the D-shaped recess 98 prevents the stand 88 from being rotated with respect to the wall.

On the head 90 are two wings 106 which have a semi-circular cross-section like the wings 42 of the stand 30 (FIG. 1). Between the wings 106 is a groove 108 which has a generally semi-circular cross-section. As best seen in FIG. 15, the groove 108 is curved about a radius of curvature r where the radius of curvature is perpendicular to the central axis Z of the stand 88.

The stand 88 is used in connection with a cap 110 and rings 112 (FIG. 17). The cap 110 is shaped similarly to the cap 44 of FIGS. 5–7 and has wings 114. The rings 112 fit over the wings 106 and 114 in order to hold the cap 110 in place over the stand 92. The semi-circular grooves on the stand 88 and the cap 110 form a generally circular opening through the mounting mechanism in order to hold a resonator 58 which has a circular cross-section. The groove of the cap 1 10 is curved like the groove 108 (FIG. 14) so that the opening between the cap 110 and the stand 88 complements the curvature of the inner edge 62 and outer edge 64 of the resonator 58. Because of the shape of the grooves 108, 110, the resonator 58 is held so that its radius of curvature is perpendicular to the central axis of the stand 88.

Figure 19:
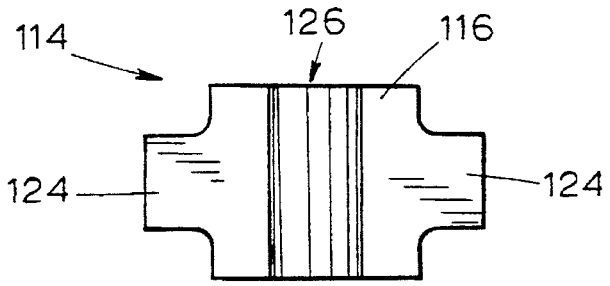
FIG. 19 is a top-plan view of the resonator mounting mechanism of FIG. 18.
Figure 20:
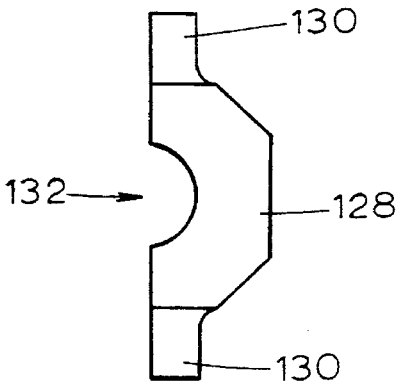
FIG. 20 is a side view of a cap for a resonator mounting mechanism of the present invention.

Referring now to FIGS. 18 and 19, another embodiment of a resonator mounting mechanism includes a stand 114 having a head 116 connected to a base 118 by a post 120. The base 118 has one or more threaded openings 122 for attachment to a wall or other structure. The head 116 has two wings 124 which have a semi-circular shape similar to the wings of the previous embodiments. Between the wings 124 is a groove 126. The groove 126 has a semi-circular cross-section like the groove 40 in the stand 30 (FIG. 1) and the groove 108 in the stand 88 (FIG. 14). However, the groove 126 is not curved like the groove 40 and the groove 108, but instead has a uniform cross-section throughout its length. The stand 114 is designed to be used in connection with the cap 128 shown in FIG. 20. The cap 128 has semi-circular wings 130 and a groove 132. The groove 132 has a semi-circular cross-section and is uniform along the length of the groove in order to match the groove 126 of the stand 114.

Figure 21:
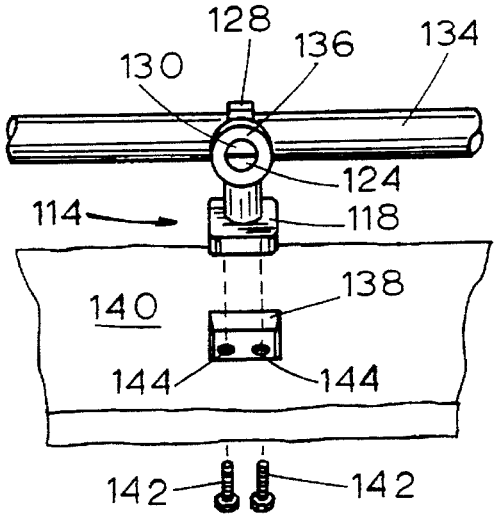
FIG. 21 is an exploded-perspective view of a resonator, mounting mechanism and wall.

The stand 114 and the cap 128 are designed to be used in connection with a rod resonator 134 (FIG. 21). The rod resonator 134 has a circular cross-section but is not curved along its major axis like the resonator 58 shown in FIGS. 10 and 11. Therefore the rod resonator 134 has a surface which is generally complementary to the uniform grooves 126 and 132 in the stand 114 and cap 128, respectively. The cap 128 is held to the stand 114 by a ring 136 which is similar in construction to the ring 50 shown in FIGS. 8 and 9. The stand 114 is designed to fit into a recess 138 in a wall 140 and be secured by bolts 142 through passageways 144.

The resonator mounting mechanisms of the present invention can be used with a variety of different resonator types including those which are superconducting. For instance, a resonator may be constructed of an alumina substrate coated with yttrium barium cupric oxides. Dielectric resonators and metallic resonators, such as those made out of copper, can also be used.

The resonator mounting mechanism of the present invention provides good structural stability while still being easy to assemble and causing few undesirable electromagnetic effects. With regard to assembly, a fixture (not depicted) can be used which temporarily locks the stand in place and then properly positions the resonator with respect to the stand. When the resonator is properly positioned, the cap and rings can be easily attached to the stand without displacing the resonator. The resonator and mounting mechanism are then released from the fixture as a single unit so that they can be attached to a wall.

The structural stability and strength of the mounting mechanism of the present invention permits designs in which the resonator is physically contacted in only one location. When the resonator is a halfwave resonator, the electric fields are lowest at the midpoint of the resonator. For instance, for the resonator 58, the midpoint is opposite the gap 66. The resonator mounting mechanism of the present invention, which can be attached solely at the midpoint of the resonator minimizes electromagnetic effects because it is in the area of the resonator's lowest electric field.

Although only circular cross-section resonators have been described herein, the resonator mounting mechanism of the present invention can be used with a variety of resonator cross-sections. It is most desirable for the grooves in the stands and the caps to match the shape and cross section of the resonator and therefore the groove may be modified to accommodate different resonator configurations. However, it is also possible to use grooves which do not precisely match the shape and/or cross-section of the resonator. For instance, V-shaped grooves can be used to hold a circular cross-section resonator. It is even possible for one of the stand or the cap to be without a groove. In such instances, the resonator will contact the stand and/or the cap at only a few points rather than along larger portions of the surface of the resonator. Decreasing the amount of contact may lead to less stability for the resonator, however.

The resonator mounting mechanism can be constructed of a variety of materials, but in most instances should be an electric insulator. If a superconducting resonator is used, it may be desirable to manufacture the stand from a material which is a thermal conductor in order to help keep the resonator below its critical temperature. A polyetherimide polymer such as Ultem 2300 manufactured by General Electric may be machined to create the stand, the cap and the rings. Once the resonator mounting mechanism has been attached to a resonator, it is often desirable to use an epoxy such as CTD-620 from Composite Technology Development, Inc. to further secure the resonator. Epoxy can be placed in the comers where the resonator meets the stand and the cap and also on the inside and outside of the rings.

The dimensions of the various portions of the mounting mechanism will depend primarily on the size, shape and weight of the resonator. It will generally be desirable to design all pans of the mounting mechanism to be as small as possible within the bounds of the strength of the material used to manufacture those parts. It may be desirable to make the combined circumference of the grooves on the stand and cap slightly smaller than the circumference of the resonator. The resonator will then be pinched slightly between the cap and the stand to prevent movement of the resonator. In such a case the mounting mechanism should be made of a material that is flexible so that the wings can be pinched together to receive a ring.

The foregoing detailed description has been given for clearness of understanding only and no unnecessary limitations should be understood therefrom, as modifications would be obvious to those skilled in the art.

We claim:

1. A resonator mounting mechanism for attaching a resonator to a wall in combination with the resonator, the mounting mechanism comprising:

a stand having (a) means for securing the stand to a wall at a first end of the stand and (b) a head at a second end of the stand;

a groove formed in the head;

at least one wing on the head;

a cap having at least one wing; and means for holding the at least one wing on the cap in a fixed position with respect to the at least one wing on the head;

wherein the cap covers at least a portion of the groove in order to hold the resonator in the groove.

2. The combination of claim 1 wherein the means for securing the stand to a wall comprises:

means for restricting movement of the stand away from the wall; and means for restricting rotation of the stand with respect to the wall.

3. The combination of claim 2 wherein the means for restricting movement of the stand away from the wall comprises a threaded opening in the mechanism and a screw.

4. The combination of claim 1 wherein the stand has a central axis and the groove is generally perpendicular to the central axis.

5. The combination of claim 1 wherein the cap has a groove.

6. The combination of claim 5 wherein:

the groove of the cap is located over the groove of the head when the cap is secured to the head; and the grooves form an opening in the mechanism for holding the resonator.

7. The combination of claim 6 wherein the opening has a generally circular cross-section.

8. The combination of claim 1 wherein:

the stand has a central axis;

the groove in the head has a length; and the groove in the head is curved along its length.

9. The combination of claim 8 wherein:

the curve of the groove has a radius of curvature; and the radius of curvature lies in a plane which is generally perpendicular to the central axis of the stand.

10. The combination of claim 8 wherein:

the curve of the groove has a radius of curvature; and the radius of curvature lies in a plane which is generally parallel to the central axis of the stand.

11. The combination of claim 1 comprising:

first and second wings on the stand disposed on opposite sides of the groove of the head;

third and fourth wings on the cap disposed on opposite sides of the cap; and means for securing the first wing to the third wing and means for securing the second wing to the fourth wing to hold the cap to the stand.

12. The combination of claim 1 wherein:

the means for holding the at least one wing on the cap in a fixed position with respect to the at least one wing on the stand comprises a ring having an aperture; and the wing on the head and the wing on the cap are inserted into the aperture to secure the cap to the stand.

13. The combination of claim 12 wherein:

the aperture in the ring is circular; and each wing is semi-circular.

14. The combination of claim 12 wherein:

the aperture in the ring is bounded by at least one wall; and the wall is tapered.

15. The combination of claim 12 wherein the wings on the stand and the wings on the cap are tapered.

16. A resonator mounting mechanism for attaching a resonator to a wall, the mounting mechanism comprising:

a stand having means for securing the stand to a wall at a first end of the stand and a head at a second end of the stand;

a groove formed in the head;

first and second wings on the head disposed on opposite sides of the groove;

a cap having third and fourth wings disposed on opposite sides of the cap; and a first ring and a second ring, each ring having an aperture;

wherein the first ring secures the first wing to the third wing and the second ring secures the second wing to the fourth wing in order to hold the cap over the groove.

17. The resonator mounting mechanism of claim 16 wherein:

the cap has a groove and the groove of the cap is located over the groove of the head when the cap is secured to the head; and the grooves from an opening in the mechanism for holding the resonator.

18. The resonator mounting mechanism of claim 17 wherein the resonator has a cross-section and the opening has a generally complementary cross-section to the cross-section of the resonator.

19. The resonator mounting mechanism of claim 16 in combination with:

a resonator held by the resonator mounting mechanism; and a wall attached to the resonator mounting mechanism;

wherein the resonator mounting mechanism holds the resonant structure in a fixed position with respect to the wall.

* * * * *

UNITED STATES PATENT AND TRADEMARK OFFICE

CERTIFICATE OF CORRECTION

PATENT NO. : 5,604,472

DATED : February 18, 1997

INVENTOR(S) : Uppaluri et al.

It is certified that error appears in the above-identified patent and that said Letters Patent is hereby corrected as shown below:

Column 1, line 67 of the patent, "from" should be --form--.

Column 3, line 22 of the patent, "comers" should be --corners--.

Column 4, line 12 of the patent, "comers" should be --corners--.

Column 5, line 7 of the patent, "1 10" should be --110--.

Column 6, line 31 of the patent, "comers" should be --corners--.

Column 6, line 36 of the patent, "pans" should be --parts--.

Column 8, line 33 (Claim 17) of the patent, "from" should be --form--.

Signed and Sealed this

Eighth Day of July, 1997

Bruce Lehman

*Attest:*

BRUCE LEHMAN

*Attesting Officer*

*Commissioner of Patents and Trademarks*